US005348849A

United States Patent [19]

Ito

[11] Patent Number: 5,348,849

[45] Date of Patent: Sep. 20, 1994

[54] SILVER HALIDE PHOTOGRAPHIC MATERIAL

[75] Inventor: Tadashi Ito, Kanagawa, Japan

[73] Assignee: Fuji Photo Film Co., Ltd., Kanagawa, Japan

[21] Appl. No.: 77,329

[22] Filed: Jun. 16, 1993

Related U.S. Application Data

[63] Continuation of Ser. No. 781,837, Oct. 24, 1991, abandoned.

[30] Foreign Application Priority Data

Oct. 26, 1990 [JP] Japan ..... 2-288898

[51] Int. Cl.[5] ..... G03C 1/14

[52] U.S. Cl. ..... 430/574; 430/567; 430/543; 430/544; 430/599; 430/966

[58] Field of Search ..... 430/574, 567, 583, 588, 430/599, 966

[56] References Cited

U.S. PATENT DOCUMENTS

| | | | |
|---|---|---|---|
| 3,769,024 | 10/1973 | Sakazume et al. | 430/588 |
| 3,953,215 | 4/1976 | Hinata et al. | 430/574 |
| 3,957,490 | 5/1976 | Libeer et al. | 430/599 |
| 4,797,354 | 1/1989 | Saitou et al. | 430/567 |
| 5,075,198 | 12/1991 | Katoh | 430/264 |
| 5,114,838 | 5/1992 | Yamada | 430/569 |
| 5,254,456 | 10/1993 | Yamashita et al. | 430/611 |

FOREIGN PATENT DOCUMENTS 3925334 2/1990 Fed. Rep. of Germany ..... 430/588

*Primary Examiner*—Charles L. Bowers, Jr.
*Assistant Examiner*—John A. McPherson
*Attorney, Agent, or Firm*—Sughrue, Mion, Zinn, Macpeak & Seas

[57] ABSTRACT

A silver halide photographic material comprising a support and at least one light-sensitive silver halide emulsion layer coated on at least one side of the support, wherein the silver halide grains contained in the silver halide emulsion layer have been subjected to reduction-sensitization, and the silver halide emulsion contains at least one spectral sensitizer represented by Formula (I), as defined in claim 1. At least one of the dyes represented by Formula (II), as defined in claim 1, is added to the silver halide emulsion after chemical sensitization or reduction sensitization, but before coating. The addition amount of the dye represented by Formula (I) is $5\times10^{-4}$ to $3\times10^{-3}$ mol per mol of silver halide and the addition amount of the dye represented by Formula (II) is $1\times10^{-5}$ to $1\times10^{-3}$ mol per mol of silver halide, provided that the addition amount of the dye of Formula (I) is more than that of the dye of Formula (II). Such a silver halide photographic material increases the sensitivity while significantly lowering the amount of fog.

9 Claims, No Drawings

SILVER HALIDE PHOTOGRAPHIC MATERIAL

This is a continuation of application No. 07/781,837 filed Oct. 24, 1991, now abandoned.

FIELD OF THE INVENTION

The present invention relates to a silver halide photographic material, particularly to a highly sensitive silver halide photographic material containing a silver halide emulsion with little fog.

BACKGROUND OF THE INVENTION

Various antifoggants are commonly used in order to prevent fogging of a silver halide photographic material. For example, heterocyclic compounds, especially the heterocyclic compounds having mercapto groups, are well known as the antifoggants. These compounds reduce the fog caused during development and storage, but have the problem that sensitivity is lowered. Accordingly, these compounds can not be relied upon when a high sensitivity is required since the reduction of a fog also results in the deterioration of the sensitivity. Further, the problem that the photographic light-sensitive material is desensitized during storage can not completely be avoided.

One of the methods for solving these problems is disclosed in JP-A-62-174742 (the term "JP" as used herein means an unexamined published Japanese patent application) and JP-A-62-174743, in which the compounds having a mercapto group are incorporated into light-insensitive layers. However, the combined use thereof with a cyanine dye, particularly a cyanine dye having a sulfoalkyl group, is insufficient when high sensitivity is required and the reduction of a fog is accompanied by a lowering of sensitivity.

In general, sensitization of a silver halide emulsion can be carried out by methods such as noble metal sensitization, sulfur sensitization, reduction sensitization, and the addition of a development accelerator. However, these methods cause an increase in fog, and therefore the above antifoggants have not been able to lower a fog to a satisfactory level because of the decrease in a sensitivity.

Further, a method for preparing a silver halide emulsion having a high sensitivity and an excellent developability is disclosed in JP-A-63-305343. In that method, chemical sensitization is carried out in the presence of a silver halide-adsorbing compound such as a sensitizing dye or a photographic characteristics stabilizer in order to control the characteristics of the silver halide grains so that the development is initiated from the peaks of the respective grains. However, this method has the problems that an excessive use of the sensitizing dye causes a stain by the dye remaining after development processing and that an excessive use of the photographic stabilizer results in difficulty in carrying out spectral sensitization thereafter.

One of the methods for solving these problems is disclosed in JP-A-2-167539, in which two kinds of dyes are used. But this method was insufficient for achieving high sensitivity.

SUMMARY OF THE INVENTION

One object of the present invention is to provide a highly sensitive silver halide photographic light-sensitive material having notably reduced fog.

These and other objects of the present invention have been achieved by a silver halide photographic material comprising a support and at least one light-sensitive silver halide emulsion layer provided on at least one side of the support, wherein the silver halide grains contained in the silver halide emulsion layer have been subjected to reduction-sensitization, the silver halide emulsion contains at least one spectral sensitizer represented by the following Formula (I), and further at least one of the dyes represented by the following Formula (II) has been added to the silver halide emulsion between the time of chemical sensitization or the time of reduction sensitization and the time before coating:

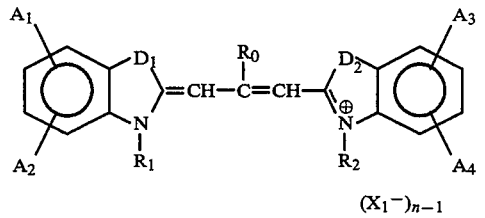

(I)

wherein $A_1$, $A_2$, $A_3$ and $A_4$ each represents a hydrogen atom, a lower alkyl group, an alkoxy group, a halogen atom, a hydroxyl group, an aryl group, a carboxyl group, an alkoxycarbonyl group, a cyano group, a trifluoromethyl group, an amino group, an acrylamide group, an acyl group, a acyloxyl group, an alkoxycarbonylamino group, and a carboalkoxy group, wherein $A_1$ and $A_2$, and $A_3$ and $A_4$ may combine with each other to form a naphthoxazole nucleus; $R_0$ represents a hydrogen atom, a lower alkyl group, or an aryl group; $D_1$ and $D_2$ each represents an oxygen atom and a sulfur atom; $R_1$ and $R_2$ each represents an alkyl group, provided that at least one of $R_1$ and $R_2$ is an alkyl group having a sulfo radical; $X_1$ represents an anion; and n is 1 or 2, provided that n is 1 when the dye forms an inner salt;

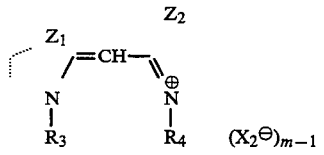

(II)

wherein $Z_1$ and $Z_2$ each represents a group of non-metallic atoms necessary to complete a thiazole nucleus, a thiazoline nucleus, an oxazole nucleus, a selenazole nucleus, a 3,3-dialkylindolenine nucleus, an imidazole nucleus, or a pyridine nucleus; $R_3$ and $R_4$ each represents an alkyl group; $X_2$ represents an anion; and m is 1 or 2, provided that m is 1 when the dye forms an inner salt.

DETAILED DESCRIPTION OF THE INVENTION

It would not been expected from the prior art that a fog in sensitization, particularly a reduction sensitization, could be reduced by adding the dye of Formula (II) without lowering sensitivity to a large extent, as was found in the present invention.

In Formula (I), $A_1$, $A_2$, $A_3$ and $A_4$ each represents a hydrogen atom, a lower alkyl group having preferably 1 to 4 carbon atoms (e.g., methyl, ethyl and n-propyl), a halogen atom (e.g., chlorine, bromide, fluorine and iodine), an alkoxy group having preferably an alkyl radical of 1 to 4 carbon atoms (e.g., methoxy and ethoxy), a hydroxyl group, a monoaryl group (e.g., phenyl and sulfo-substituted phenyl such as p-sulfophenyl), a carboxyl group, an alkoxycarbonyl group having preferably an alkyl radical of 1 to 4 carbon atoms (e.g., methoxycarbonyl and ethoxycarbonyl), a cyano group, a trifluoromethyl group, an amino group (amino and lower alkylsubstituted amino such as methylamino and dimethylamino), an acylamide group (e.g., acetamide), an acyl group (e.g., acetyl), an acyloxyl group (e.g., acetoxy), an alkoxycarbonylamino group having preferably an alkyl radical of 1 to 4 carbon atoms (e.g. ethoxycarbonylamino), or a carboalkoxy group having preferably an alkyl radical of 1 to 4 carbon atoms (e.g., carboethoxy), provided that $A_1$ and $A_2$, and $A_3$ and $A_4$ may combine with each other to form a naphthoxazole nucleus (e.g., naphtho[2,1-d]oxazole, naphtho[1,2-d]oxazole and naphtho[2,3-d] oxazole). The lower alkyl groups generally have 1 to 10 carbon atoms.

$D_1$ and $D_2$ each represents an oxygen atom or a sulfur atom.

$R_0$ represents a hydrogen atom, a lower alkyl group having preferably 1 to 4 carbon atoms (e.g., methyl and ethyl), or a monoaryl group (e.g., phenyl).

$R_1$ and $R_2$ each represents an alkyl group (an unsubstituted alkyl group having preferably 1 to 8 carbon atoms), and a substituted alkyl group (having preferably 1 to 4 carbon atoms) which is usually applied to constitute a cyanine dye, such as a methyl, an ethyl, an n-propyl, a vinylmethyl, a hydroxyalkyl group (e.g., 2-hydroxyethyl and 4-hydroxybutyl), an acetoxyalkyl group (e.g., 2-acetoxyethyl and 3-acetoxypropyl), an alkoxyalkyl group (e.g., 2-methoxyethyl and 4-butoxybutyl), an alkyl group having a carboxy radical, such as 2-carboxyethyl, 3-carboxypropyl, 2-(2-carboxyethoxy)ethyl, and p-carboxybenzyl), an alkyl group having a sulfo radical (e.g., 2-sulfoethyl, 3-sufloprpyl, 3-sulfobutyl, 4-sufobutyl, 2-hydroxy-3-sulfopropyl, 2-(3-sulfopropoxy)ethyl, 2-acetoxy-3-sulfopropyl, 3-methoxy-2-(3-sufopropoxy)propyl, 2-[2-(3-sulfopropoxy)ethoxy]ethyl, 2-hydroxy-3-(3'-sulfopropoxy)propyl, p-sulfophenethyl, and p-sulfobenzyl), and an aralkyl group (e.g., benzyl and phenethyl), provided that at least one of $R_1$ and $R_2$ is an alkyl group having a sulfo radical.

$X_1$ represents an anion usually applied to constitute a cyanine dye (e.g., a chloride ion, a bromide ion, an iodide ion, a mineral acid ion such as a thiocyanic acid ion, a sulfuric acid ion and a perchloric acid ion and an organic acid ion such as a p-toluenesulfonic acid ion, a methylsulfuric acid ion and an ethylsulfuric acid ion), and n is 1 or 2, provided that n is 1 when the dye forms an inner salt.

In Formula (II), $Z_1$ and $Z_2$ each represents a group of non-metallic atoms necessary to complete the following heterocyclic nuclei, i.e., a thiazole nucleus which may have groups such as a lower alkyl group, a monoaryl group, a halogen atom, a lower alkoxy group, a carboxy group, a lower alkoxycarbonyl group, a monoaralkyl group, a trifuluromethyl group, and a hydroxy group, (e.g., thiazole, 4-methylthiazole, 4-phenylthizole, 4,5-dimethylthiazole, 4,5-diphenylthiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifuluoromethylbenzothiazole, 5,6-dimethylbenzothiazole, 5-hydroxy-6-methylbenzothiazole, tetrahydrobenzothiazole, 4-phenylbenzothiazole, 5-phenylbenzothiazole, naphtho[2,1-d]thiazole, naphtho[1,2-d] thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, and 5-methoxy[2,3-d]thiazole); a thiazoline nucleus which may have a group such as a lower alkyl group (e.g., thiazoline and 4- methylthiazoline); an oxazole nucleus which may have groups such as a lower alkyl group, a halogen atom, a monaryl group, a lower alkoxy group, a trifluoromethyl group, a hydroxy group and a carboxy group (e.g., oxazole, 4-methyloxazole, 4-ethyloxazole, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxy-benzoxazole, naphtho[2,1-d]oxazole, naphtho[1,2-d]oxazole, and naptho[2,3-d]oxazole); a selanazole nucleus which may have groups such as a lower alkyl group, a monoaryl group, a halogen atom, a lower alkoxy group, and a hydroxy group (e.g., 4-methylselenazole, 4-phenylselenazole, benzoselenazole, 5-chlorobenzoselenazole, 5-methoxybenzoselenazole, 5-methylbenzoselenazole, -5hydroxybenzoselenazole, naphtho[2,1-d]selenazole, and naphtho[1,2-d]selenazole nucleus); a 3,3-di-lower-alkylindolenine nucleus which may have a cyano group, a lower alkyl group and a halogen atom (e.g., 3,3-dimethylindolenine, 3,3-diethylindolenine, 3,3-dimethyl-5-cyanoindolenine, 3,3-dimethyl- 5-methoxyindolenine, 3,3-dimethyl-5-methyl-indolenine, and 3,3-dimethyl-5-chloroindolenine); an imidazole nucleus which may have groups such as a lower alkyl group, monoaryl group, a halogen atom, a lower alkoxy group, a cyano group, a trifluoromethyl group and an allyl group (e.g., 1-methylimidazole, 1-ethylimidazole, 1-methyl-4-phenylimidazole, 1-ethyl-4-phenylimidazole, 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-alkyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-methyl-5-trifluoromethylbenzimidazole, 1-ethyl-5-trifuloromethylbenzimidazole, 1-ethylnaphtho[1,2-d]imidazole, 1-allyl-5,6-dichlorobenzimidazole, 1-allyl-5-chlorobenzimidazole, 1-phenylimidazole, 1-phenylbenzimidazole, 1-phenyl-5-chlorobenzimidazole, 1-phenyl-5,6-dichlorobenzimidazole, 1-phenyl-5-methoxy-benzimidazole, 1-phenyl-5-cyanobenzimidazole, and 1-phenylnaphtho[1,2-d]imidazole); and a pyridine nucleus which may have a group such as a lower alkyl group (e.g., pyridine, 5-methyl-2-pyridine, and 3-methyl-4-pyridine).

$R_3$ and $R_4$ each represents an alkyl group such as those defined for $R_1$ and $R_2$.

$X_2$ represents the same anion as those defined for $X_1$, and m is 1 or 2, provided that m is 1 when the dye forms an inner salt.

Typical examples of the sensitizing dyes represented by Formula (I), which can be used in the present invention, are shown below, but are not limited thereto:
(I-1)
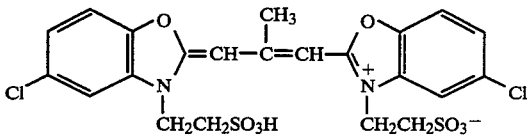
(I-2)
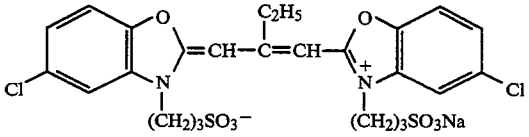
(I-3)
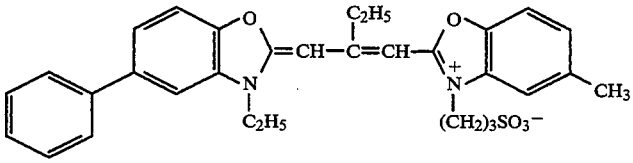
(I-4)
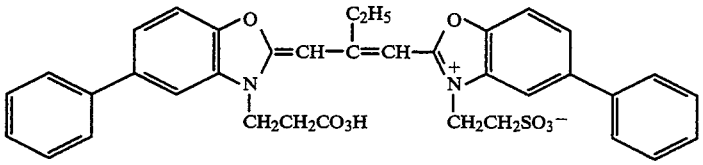
(I-5)
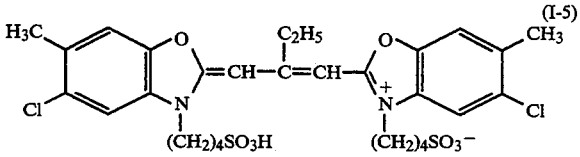
(I-6)
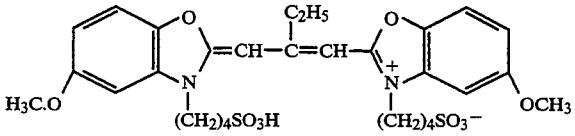
(I-7)
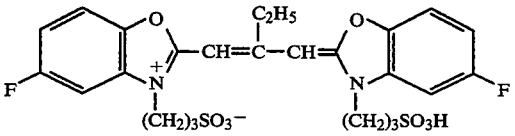
(I-8)
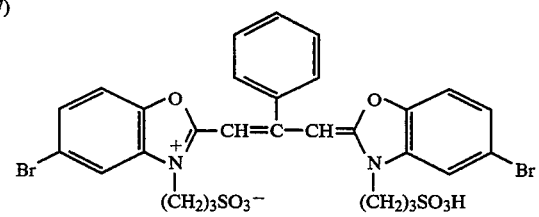
(I-9)
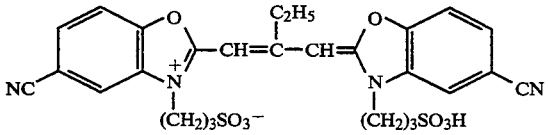
(I-10)
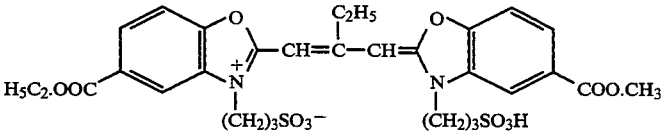
(I-11)
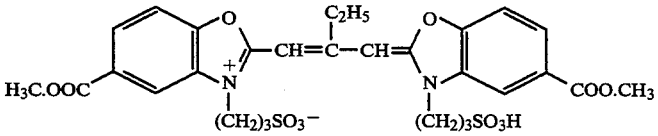
(I-12)
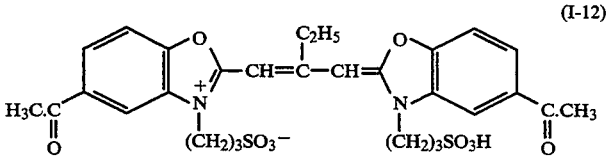
(I-13)
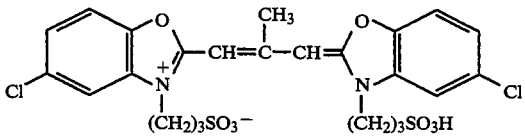

-continued
(I-14)
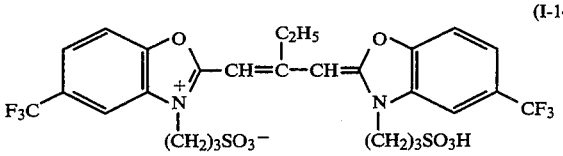
(I-15)
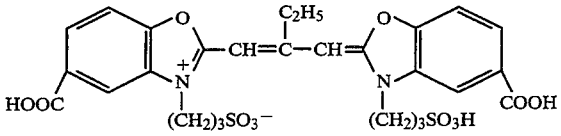
(I-16)
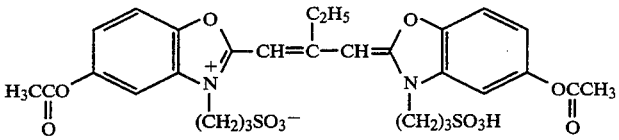
(I-17)
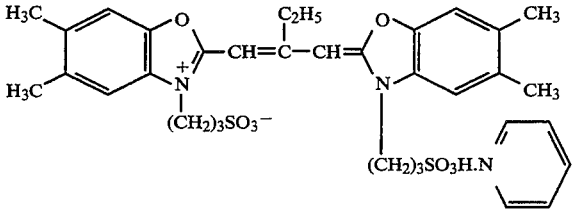
(I-18)
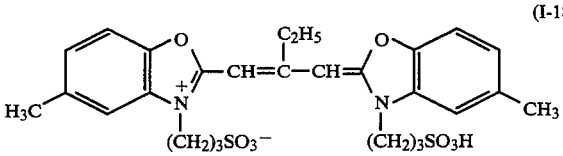
(I-19)
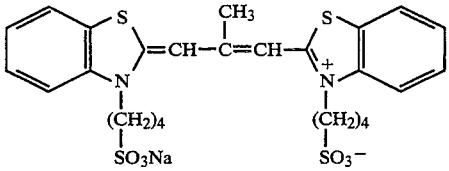
(I-20)
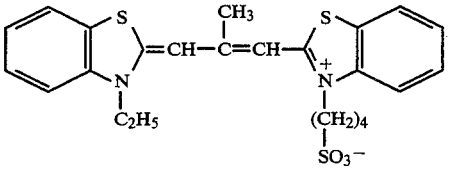
(I-21)
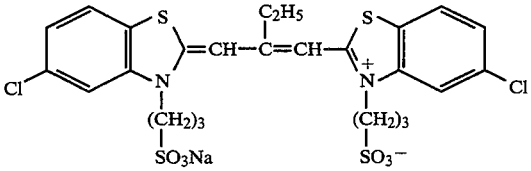
(I-22)
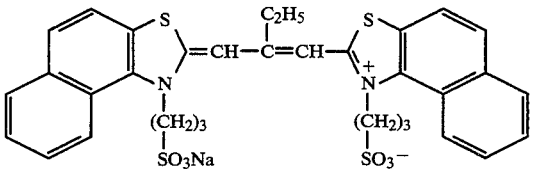
(I-23)
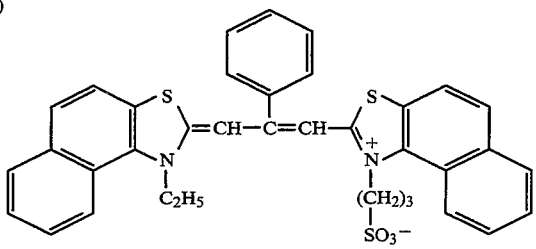
(I-24)
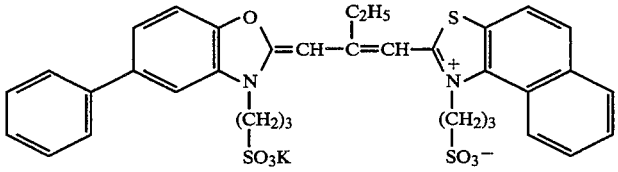
(I-25)
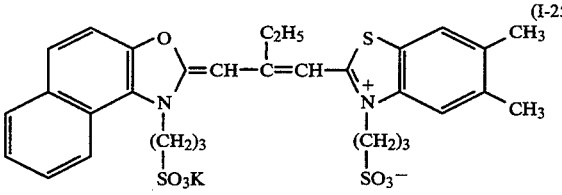
(I-26)
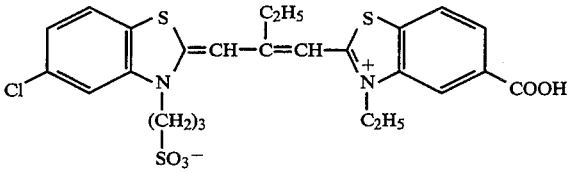

-continued
(I-27)
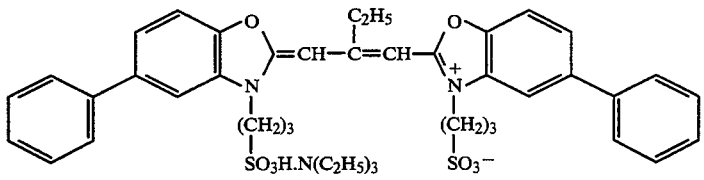
(I-28)
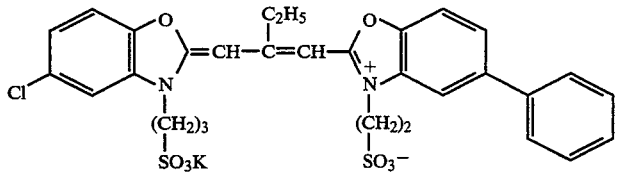
(I-29)
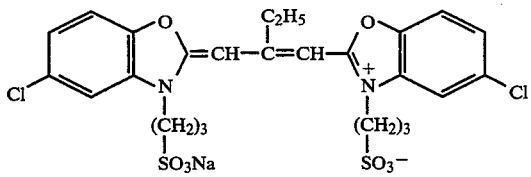
(I-30)
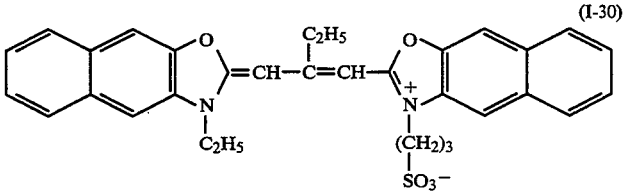
(I-31)
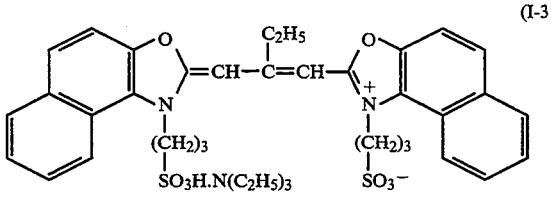
Typical examples of the dyes represented by Formula (II), which can be used in the present invention, are shown below, but are not limited thereto:
(II-1)
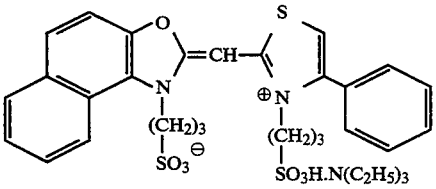
(II-2)
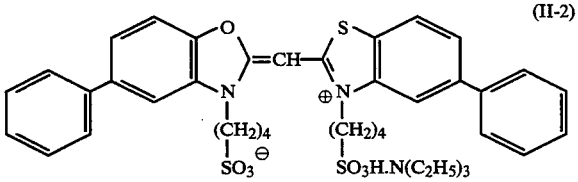
(II-3)
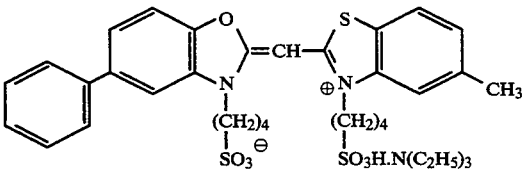
(II-4)
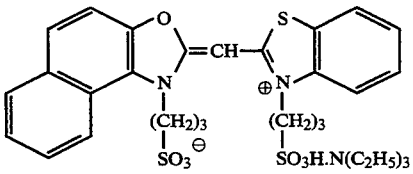
-continued
(II-5)
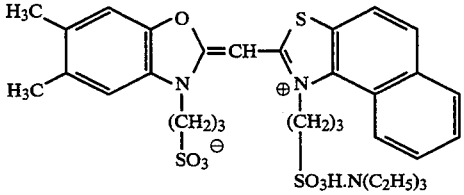
(II-6)
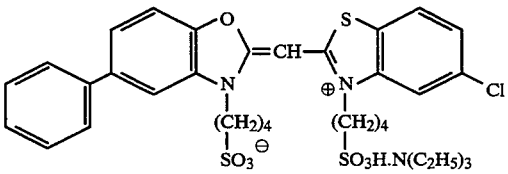
(II-7)
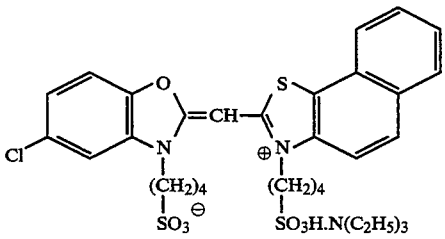
(II-8)
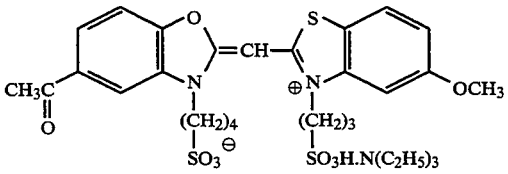

-continued
(II-9)
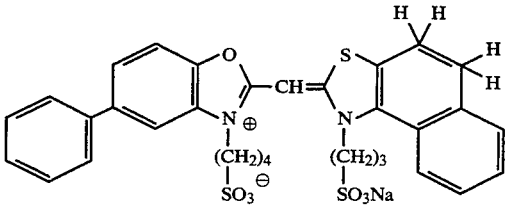
(II-10)
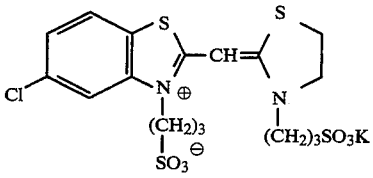
(II-11)
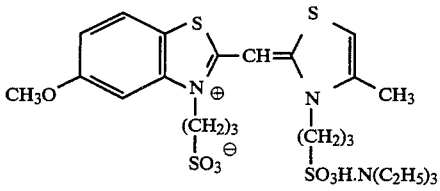
(II-12)
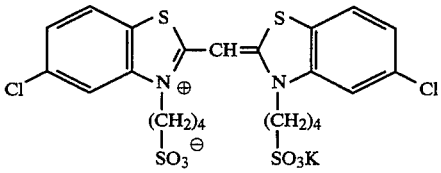
(II-13)
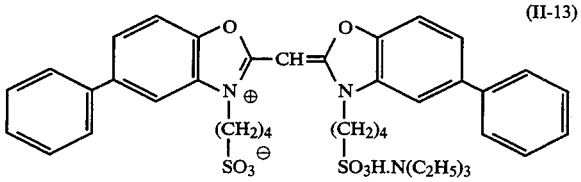
(II-14)
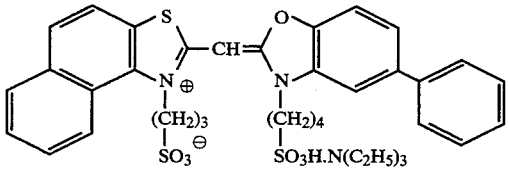
(II-15)
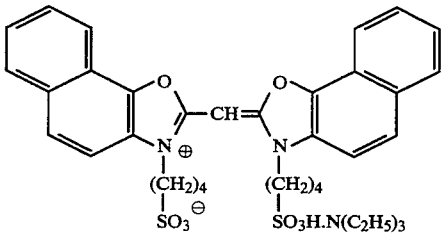
(II-16)
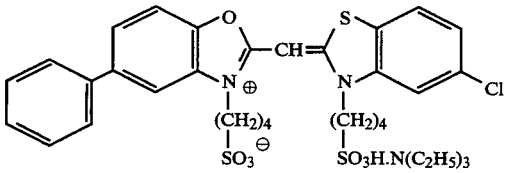
-continued
(II-17)
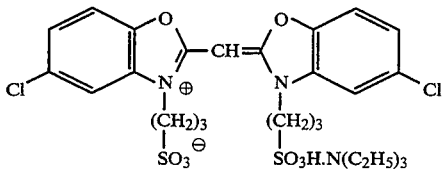
(II-18)
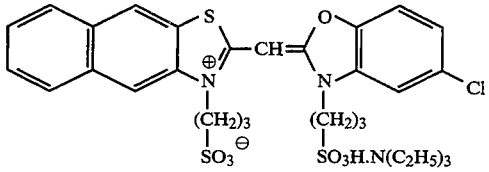
(II-19)
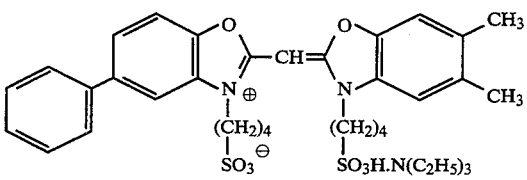
(II-20)
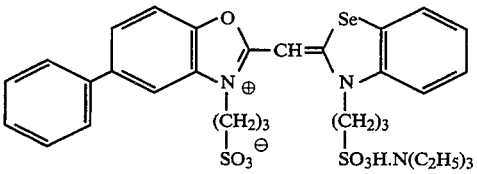
(II-21)
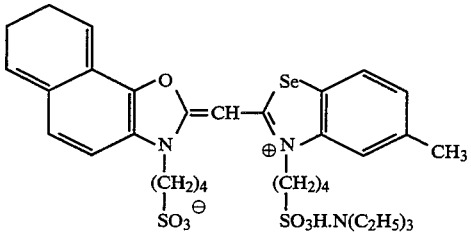
(II-22)
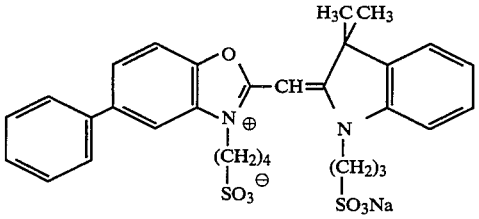
(II-23)
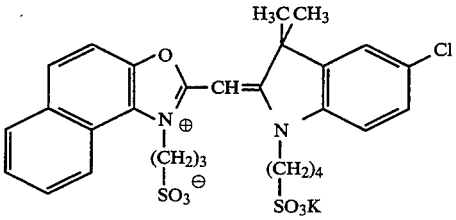
(II-24)
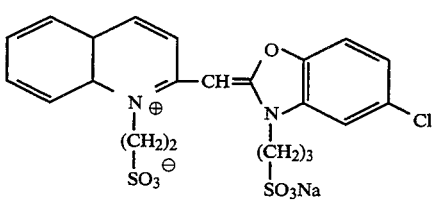

-continued (II-25)

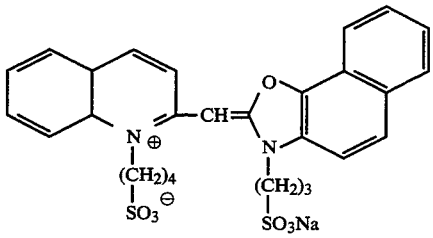

(II-26)

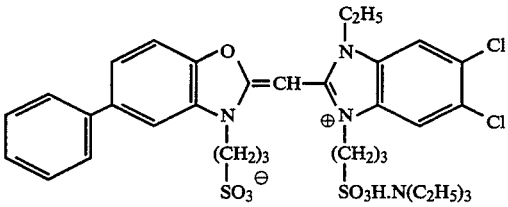

(II-27)

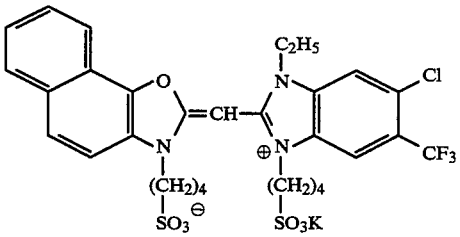

(II-28)

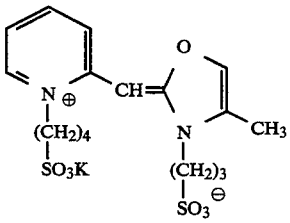

(II-29)

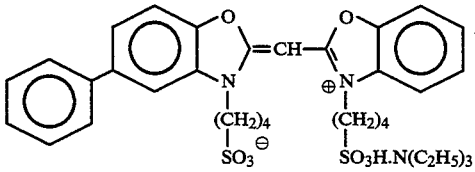

(II-30)

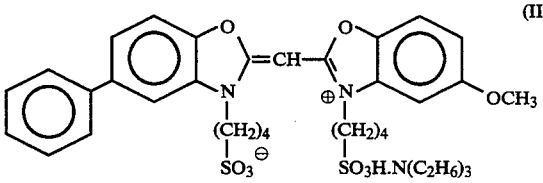

(II-31)

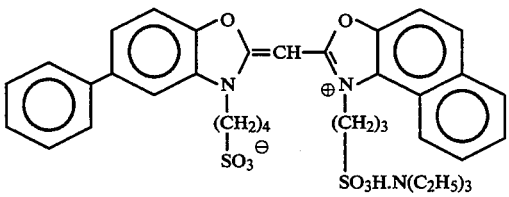

-continued (II-32)

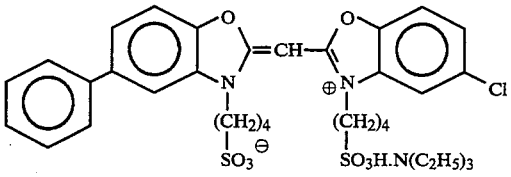

(II-33)

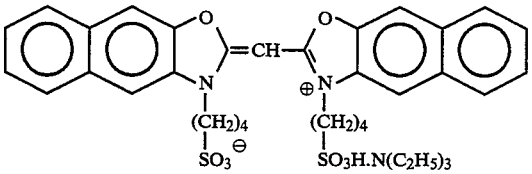

(II-34)

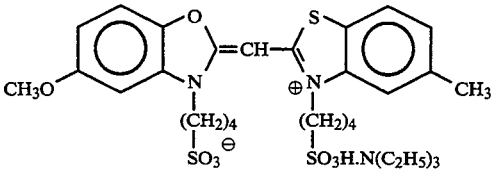

The addition amount of the sensitizing dye of Formula (I) is $5\times10^{-4}$ to $3\times10^{-3}$ mol, preferably $6\times10^{-4}$ to $1.2\times10^{-3}$ mol, per mol of silver halide.

The addition amount of the dye of Formula (II) is $1\times10^{-5}$ to $1\times10^{-3}$ mol, preferably $2\times10^{-5}$ to $5\times10^{-4}$ mol per mol of silver halide.

The addition amount of the sensitizing dye of Formula (I) is preferably more than that of the dye of Formula (II).

The time for adding the sensitizing dye of Formula (I) may be during grain formation, immediately after the completion of the grain formation, in a desairing step by washing with water, before starting a post-ripening or during the post-ripening. It is added preferably before adding a chemical sensitizer, e.g., a gold sensitizer and a sulfur sensitizer, or at the same time as the addition of the chemical sensitizer.

The time for adding the dye of Formula (II) must be between the time of chemical sensitization or the time of reduction sensitization and the time of before coating. Preferably, the dye of Formula (II) is added at immediately before coating.

The addition conditions for the sensitizing dyes of Formula (I) and the dye of Formula (II) are preferably a temperature of 30° to 80° C., a pH of 5 to 9 and a pAg of 7 to 9.

In the present invention, the reduction sensitization may be carried out at an initial stage of grain formation, i.e., during the formation of a grain nucleus, during physical ripening, or during grain growth, or before or after a chemical sensitization.

In the present invention, the chemical sensitization means a sulfur sensitization and/or a noble metal sensitization, and the noble sensitization includes gold sensitization, selenium sensitization and palladium sensitization.

When chemical sensitization is carried out in combination with gold sensitization, the reduction sensitization is preferably performed prior to the gold sensitization so that an unfavorable fog is not caused.

Most preferable is the method in which reduction sensitization is carried out during the growth of the silver halide grains, wherein the reduction sensitization may be carried out during physical ripening of silver halide grains, during the growth of the grains by adding a water-soluble silver salt and a water-soluble alkali halide, or during the course of growth of the grains in which the growth is stopped temporarily and started again after the reduction sensitization.

In the present invention, the reduction sensitization may be a method in which a conventional reducing agent is added to a silver halide emulsion, a method in which the grains are grown or ripened at a pAg as low as 1 to 7, which is called a silver ripening, and a method in which the grains are grown at a pH as high as 8 to 11, which is called a high pH ripening. Two or more methods may be applied in combination.

The method in which a reduction sensitizer is added is preferable since the level of the reduction sensitization can be finely controlled.

Examples of conventional reduction sensitizers include a stannous salt, amines and polyamines, a hydrazine derivative, formamidinesulfinic acid, a silane compound, an ascorbic acid compound, and a borane compound. One of these conventional compounds can be used in the present invention, or two or more compounds can be used in combination. The preferable reduction sensitizers are ascorbic acid, thiourea dioxide and dimethylamine borane.

The addition amount of the reduction sensitizer is dependent on the preparation conditions of the emulsion and therefore has to be controlled. It is preferably $10^{-8}$ to $10^{-3}$ mol, more preferably $10^{-7}$ to $10^{-5}$ mol, per mol of silver halide.

The reduction sensitizer dissolved in water or a solvent (such as alcohols, glycols, ketones, esters and amides) can be added during grain formation, before or after chemical sensitization. It may be added at any step of grain preparation, particularly preferably during the growth of the grains and/or prior to the chemical sensitization after the completion of grain formation. When the reduction sensitizer is added during grain growth, it may be incorporated in advance into a reaction vessel but is preferably added at an appropriate time during grain formation. An aqueous silver salt solution and an aqueous alkali halide solution, in either of which the reduction sensitizer is dissolved in advance, may be used for grain formation. A reduction sensitizer solution may be separately added several times or continuously during the course of grain formation over a prolonged period.

In the present invention, the thiosulfonic acid compound described in JP-A-2-191938 is preferably used in combination with the reduction sensitizer.

The known sulfur sensitizers can be used in the present invention. Examples thereof include thiosulfate, allylthiocarbamide thiourea, allylisothiacyanate, cystine, p-toluenethiosulfonate, and rhodanine. In addition thereto, the sulfur sensitizers described in U.S. Pat. Nos. 1,574,944, 2,410,689, 2,278,947, 2,728,668, 3,501,313, and 3,656,955, German Patent 1,422,869, JP-A-56-24937, and JP-A-55-45016 can be used. The sulfur sensitizer may be added in an amount sufficient to increase efficiently the sensitivity of the emulsion. This amount varies over quite a wide range under the various conditions such as the addition amount of hydroxy azaindene, pH, temperature and the sizes of the silver halide grains. The standard addition amount thereof is preferably $10^{-5}$ to about $10^{-1}$ mol per mol of silver halide.

In the present invention, the sulfur sensitization can be replaced by a selenium sensitization and the examples of the selenium sensitizer for the selenium sensitization include aliphatic isoselenocyanates such as allylisoselenocyanate, selenoureas, selenoketones, selenoamides, selenocarboxylic acids and esters, selenophosphates, and selenides such as diethyl-selenide and diethyldiselenide. Examples thereof are described in U.S. Pat. Nos. 1,574,944, 1,602,592 and 1,623,499.

The addition amount thereof varies widely as does that of the sulfur sensitizer. The standard addition amount thereof is about $1\times10^{-9}$ to $1\times10^{-6}$ mol per mol of silver halide.

In the present invention, various gold compounds, either monovalent or trivalent can be used as the gold sensitizer. Examples thereof include chloroaurate, potassium chloroaurate, auric trichloride, potassium auric thiocyanate, potassium rhodoaurate, tetracyano auric acid, ammonium aurothiocyanate, and pyridyltrichlorogold.

The combined use of the sulfur sensitization or selenium sensitization with the gold sensitization forms a gold nucleus and a silver sulfide-gold nucleus or a silver selenide-gold nucleus. The number thereof and particularly, the composition of the silver sulfuide-gold nucleus or silver selenide-gold nucleus has a large affect on the electron trap property and the developability. Accordingly, as the addition ratio of the gold sensitizer to the sulfur sensitizer or selenium sensitizer largely affects the sensitizing effect, the amount sufficient to efficiently increase the sensitivity of an emulsion may be decided according to the ripening conditions. The ratio of the gold sensitizer to the sulfur sensitizer or selenium sensitizer is controlled preferably so that the ratio of gold atoms to the sulfur or selenium atoms forming silver sulfide from the sulfur sensitizer or selenium atoms forming silver selenide from the selenium sensitizer becomes ½ to 1/200 in terms of number.

The time for adding the gold sensitizer may be at the same time as the addition of the sulfur sensitizer or selenium sensitizer, or during or after the sulfur sensitization or selenium sensitization.

In the present invention, the use of an emulsion comprising tabular silver halide grains can provide a particularly notable effect.

Next, the tabular silver halide grains use in the present invention are explained in more detail.

A tabular silver halide emulsion is described in *Evolution of the Morphology of Silver Bromide Crystals During Physical Ripening,* written by Cugnac and Chateau, published in Science et Industrie Photography, Vol. 33, No. 2 (1962) pp. 121 to 125; Photographic Emulsion Chemistry, written by Duffin, published by Focal Press, New York, 1966, pp. 66 to 72; and *Photographic Journal,* Vol. 80, pp. 285 (1940), written by A. P. H. Trivelli and W. F. Smith. It can be easily prepared with reference to the methods described in JP-A-58-127921, JP-A-58-113927 and JP-A-58-113928 and U.S. Pat. No. 4,439,520.

Further, it can be prepared by forming seed grains comprising 40% by weight or more of the tabular grains at relatively low pBr of 1.3 or less and adding simultaneously a silver salt solution and a halide solution while keeping the pBr value at the same level as above to grow the seed grains. In this grain growing step, the silver salt and halide solutions are added preferably so that the new crystal nuclei are not formed.

The sizes of the tabular silver halide grains can be controlled by controlling the temperature, selecting the kind and amount of the solvent and controlling the adding rates of silver salts to be used at the grain growth and halides.

Of the tabular silver halide grains, the monodispersed hexagonal tabular grains are especially useful. The structure and detailed preparation methods of monodispersed hexagonal tabular grains are described in JP-A-63-151618. A brief explanation thereof is given below: the emulsion comprises a dispersant and silver halide grains in which the hexagonal grains having a ratio of the longest side to the shortest side of 2 or less and two parallel outer surfaces share 70% or more of the whole projected area of the grains; and the grains are of a monodispersion in which the variation coefficient in the grain size distribution of the hexagonal tabular silver halide grains is 20% or less, wherein the variation coefficient is defined by the value obtained by deviding the standard deviation of the grain sizes expressed by the diameters of the circles corresponding to the projected area of the grains with the average grain size.

The crystal structure thereof may be uniform, preferably having different compositions in the inside and outer layers. It may have a layered structure. Further, the grains preferably contain therein the reduction sensitized silver nuclei.

In the tabular grains used in the present invention, an average aspect ratio of the silver halide grains corresponding to at least 50% of the whole projected area is 3.0 or more. The aspect ratio of all grains having a thickness of 0.3 μm or less is preferably 3 or more, particularly 5 to 10.

The average diameter of the circles having the area corresponding to the projected area of the tabular grains used in the present invention is preferably 0.3 to 2.0 μm, particularly 0.5 to 1.6 μm. The distance (a thickness of a grain) between the parallel planes is preferably 0.05 to 0.3 μm, particularly 0.1 to 0.25 μm.

In the present invention, the so-called halogen-conversion type grains described in British Patent 635,841 and U.S. Pat. No. 3,622,318 are particularly useful. The tabular silver halide grains used in the present invention can be subjected to the conversion to obtain an emulsion having a higher sensitivity.

Halogen conversion is usually carried out by adding an aqueous halide solution in which the silver salt has a smaller solubility product than those of the silver halides present on the surfaces of the grains before being subjected to the halogen conversion. For example, an aqueous potassium bromide solution and/or an aqueous potassium iodide solution are/is added to the silver chloride or silver chlorobromide tabular grains and an aqueous potassium iodide solution is added to the silver bromide or silver iodobromide tabular grains to subject the grains to the halogen conversion. The concentrations of these aqueous solutions added are preferably 30% or less, more preferably 10% or less. The halide solution for the halogen conversion is added preferably at the speed of 1 mol %/min. per mol of silver halide. Further, a sensitizing dye may be present in the halogen conversion and solution fine grains of silver bromide, silver iodobromide and silver iodide may be added in place of the aqueous halide solution for the halogen conversion. The size of these fine grains is 0.2 μm or less, preferably 0.1 μm or less and particularly 0.05 μm or less. The conversion amount of halogens is preferably 0.1 to 1 mol %, particularly 0.1 to 0.6 mol % of silver halides present before carrying out the halogen conversion.

The halogen conversion method used in the present invention is not limited to any one of the above methods and these methods can be used in combination according to the purpose. The composition of the surface of the grains before carrying out the halogen conversion has preferably an iodide content of 3 mol % or less, particularly 1.0 mol % or less.

It is particularly preferable that a silver halide solvent is present when carrying out halogen conversion by the above methods. The preferable solvents are a thioether compound, thiocyanate, ammonia, and a 4-substituted thiourea. Among them, the thioether compound and thiocyanate are particularly effective. The thioether compound and thiocyanate are added in the amounts of 0.2 to 3 g per mol of silver halide and 0.5 to 5 per mol of silver halide, respectively.

Further, in the present invention, there may be used in combination the compounds which release inhibitors during developing, as disclosed in JP-A-61-230135 and JP-A-63-25653.

There may coexist a cadmium salt, a zinc salt, a lead salt, a thallium salt, an iridium salt or a complex salt thereof, a rhodium salt or a complex salt thereof, and an iron salt or a complex salt thereof at the step of silver halide grain formation or physical ripening during the preparation of silver halides.

Further, there may be present in the emulsion silver halide solvents such as thiocyanate, ammonia, a thioether compound, thiazolidinethione, and 4-substituted thiourea. Among them, thiocyanate, ammonia and the thioether compound are the preferable solvents for the present invention.

The silver halide grains which are controlled so that the development thereof is initiated at the corners or in the vicinity of the corners of the grains as described JP-A-63-305343 are very useful as the tabular grains used in the present invention.

The photographic emulsions used in the present invention may contain various compounds for the purposes of preventing fog in preparing, storing and photographic processing of the light-sensitive materials and stabilizing the photographic properties. Examples thereof include azoles such as benzothiazoliumsalts, nitroimidazoles, nitrobenzimidazoles, chlorobenzimidazoles, bromobenzimidazoles, nitroindazoles, benzotriazoles, and aminotriazoles; mercapto compounds such as mercaptothiazoles, mercaptobenzothiazoles, mercaptobenzimidazoles, mercaptothiadiazoles, mercaptotetrazoles, mercaptopyrimidines, and mercaptotriadines; thioketo compounds such as oxazolinethion; azaindenes such as triazaindenes, tetraazaindenes [in particular, 4-hydroxy substituted (1,3,3*a*,7) tetraazaindenes], and pentaazaindenes; and many compounds which are known as antifoggants and stabilizers, such as benzenethiosulfonic acid, benzenesulfinic acid, and benzenesulfonic acid amide.

Among them, particularly preferred are nitrons and the derivatives thereof described in JP-A-60-76743 and JP-A-60-87322; the mercapto compounds described in JP-A-60-80839; the heterocyclic compounds described in JP-A-57-164735; and the complex salts of heterocyclic compounds and silver (e.g. silver 1-phenyl-5-mercaptotetrazole).

The photographic emulsion layers and other hydrophilic colloid layers of the light-sensitive materials prepared according to the present invention may contain various surfactants for various purposes such as a coating aid, prevention of electrification, improvement in sliding properties, emulsification-dispersion, prevention of sticking, and improvement in the photographic characteristics (e.g. acceleration of development, film hardening and sensitization).

Examples thereof include nonionic surfactants such as saponin (steroid type), alkylene oxide derivatives (e.g. polyethylene glycol, a polyethylene glycol/polypropyrene glycol condensation product, polyethylene glycol alkyl ethers, polyethylene glycol alkyl aryl ethers, and adducts of silicon and polyethylene oxide), and alkylesters of sucrose; anionic surfactants such as alkylsufonic acid salts, alkylbenzenesulfonic acid salts, alkylnaphthalenesulfonic acid salts, alkyl sulfates, N-acryl-N-alkyltaurines, sulfosuccinates, and sulfoalkyl polyoxyethylenealkylphenyl ethers; amphoteric surfactants such as alkylbetains and alkylsufobetains; and cationic surfactants such as aliphatic or aromatic quaternary ammonium salts, pyridinium salts, and imidazolium salts.

Among them, particularly preferred are anionic surfactants such as saponin, sodium dodecylbenzenesulfonate, sodium di-2-ethylhexyl-$\alpha$-sulfosuccinate, sodium p-octylphenoxyethoxyethanesulfonate, sodium dodecylsulfate, sodium triisopropylnaphthalenesulfonate, and sodium N-methyloleoyltaurine; cationic surfactants such as dodecyltrimethylammonium chloride, N-oleoyl-N',N',N'-trimethylammoniodiaminopropanebromide, and dodecylpyridium chloride; amphoteric surfactants such as betaines including N-dodecyl-N,N-dimethylcarboxybetaine and N-oleyl-N,N-dimethylsulfobutylbetaine; and nonionic surfactants such as polyoxyethylene cetyl ether (average polymerization degree: 10), polyoxyethylene-p-nonyl-phenol ether (polymerization degree: 25), and bis(1-polyoxyethylene-oxy-2,4-di-t-pentylphenyl) ethane (polymerization degree: 15).

The preferable examples of the antistatic agents are fluorinated surfactants such as potassium perfluorooctanesulfonate, N-propyl-N-perfluorooctanesulfonyl glycine sodium salt, N-propyl-N-perfluorooctanesulfonylaminoethyloxy polyoxyethylenebutane-sulfonic acid sodium salt (polymerization degree: 3), and N-perfluoro-octanesulfonyl-N',N',N'-trimethylammoniodiaminopropane chloride and N-perfluorodecanoylaminopropyl-N',N'-dimethyl-N'-carboxybetaine;nonionic surfactants described in JP-A-60-80848, JP-A-61-112144, JP-A-62-172343 and JP-A-62-173459; alkali metal nitrates; electroconductive tin oxide; zinc oxide; vanadium pentaoxide; and composite oxides in which antimony is doped to the above metal oxides.

Examples of the matting agents used in the present invention include homopolymers of methyl methacrylate, copolymers of methyl methacrylate and methacrylic acid, organic compounds such as starch, and fine particles of inorganic compounds such as silica, titanium dioxide, sulfate, strontium and barium, as described in U.S. Pat. Nos. 2,992,101, 2,701,245, 4,142,894 and 4,396,706.

The particle size thereof is preferably 1.0 to 10 $\mu$m, particularly 2 to 5 $\mu$m.

The surface layer of the photographic material of the present invention can contain as a lubricant the silicone compounds described in U.S. Pat. Nos. 3,489,576 and 4,047,958, and the colloidal silica described in JP-B-56-23139 (the term "JP-B" as used herein means examined Japanese patent publication) as well as paraffin wax, higher fatty acid ester and a starch derivative.

The hydrophilic colloid layers of the photographic material of the present invention can contain as a plasticizer a polyol such as trimethylol propane, pentanediol, butanediol, ethylene glycol and glycerine.

Gelatin is used as a binder or protective colloid which can be used for the emulsion layers, intermediate layers and surface protective layers of the photographic material of the present invention. In addition to gelatin, hydrophilic collides can be used as well. Examples thereof include proteins such as a gelatin derivative, a graft polymer of gelatin and other polymers, albumin and casein; cellulose derivatives such as hydroxyethylcellulose, caboxymethylcellulose and cellulose sulfuric acid esters; sucrose derivatives such as sodium alginate, dextran and a starch derivative; and various synthetic hydrophilic polymers such as homopolymers and copolymers of vinyl alcohol, partially-acetalized vinyl alcohol, N-vinylpyrrolidone, acrylic acid, methacrylic acid, acrylamide, vinylimidazole, and vinylpyrazole.

There may be used acid-treated gelatin and enzyme-treated gelatin as well as lime-treated gelatin, and a hydrolysis product and a enzyme-decomposed product of gelatin can be used as well.

Among them, dextran having an average molecular weight of 5,000 to 100,000 and polyacrylamide are used preferably in combination with gelatin. The methods described in JP-A-63-68837 and JP-A-63-149641 are also effective in the present invention.

The photographic emulsions and light-insensitive hydrophilic colloids used in the present invention may contain an inorganic or organic hardener. Examples thereof include chromium salts (e.g., chromie alum), aldehydes (e.g., formaldehyde and glutaric aldehyde), N-methylol compounds (e.g., dimethylol urea), dioxane derivatives (2,3-dihydroxydioxane), active vinyl compounds (e.g., 1,3,5-triacryloyl-hexahydro-s-triazine, bis(vinylsulfonyl) methyl ether, and N,N'-methylene bis-[$\beta$-(vinylsulfonyl)propionamide]), active halogen compounds (e.g., 2,4-dichloro-6-hydroxy-s-triazine), mucohalogenic acids (e.g., mucochloric acid), isoxazoles, dialdehyde starch, and 2-chloro-6-hydroxytriazinylized gelatin. They can be used singly or in combination thereof. Preferred among them are the active vinyl compounds described in JP-A-53-41221, JP-A-53-57257, JP-A-59-162546 and JP-A-60-80846 and the active halogen compounds described in U.S. Pat. No. 3,325,287.

Effective as well are N-carbamoyl-pyridinium salts (e.g. 1-morpholinocarbonyl-3-pyridinio-methanesulfonate), and haloamidinium salts (e.g. 1-(1-chloro-1-pyridinomethylene)pyrrolidinium-2-naphthalene sulfonate).

A polymer hardener also can be used as the hardener in the present invention. Examples of the polymer hardener used in the present invention include polymers having an aldehyde group such as dialdehyde starch, polyacrolein, and an acrolein copolymer described in U.S. Pat. No. 3,396,029; polymers having an epoxy group described in U.S. Pat. No. 3,623,878; polymers having dicholorotriazine group described in U.S. Pat. No. 3,362,827 and *Research Disclosure,* 17333 (1978); a polymer having an active ester group described in JP-A-56-66841; and polymers having an active vinyl group or a precursor group therefor described in JP-A-56-142524, JP-A-54-65033, U.S. Pat. No. 4,161,407 and *Research Disclosure,* 16725 (1978). Among them, preferred are the polymers having an active vinyl group or a precursor group thereof, and particularly preferred are the polymers in which an active vinyl group or a precursor group thereof is bonded to the main polymer chain via a long spacer as described in JP-A-56-142524.

A polyethylene terephthalate film or a cellulose triacetate film is preferred as the support.

The support is subjected preferably to a corona discharge treatment, a glow discharge treatment or an ultraviolet irradiation treatment in order to strengthen the adhesiveness thereof with a hydrophilic colloid layer. Further, the support may be provided with a subbing layer comprising a styrene-butadiene latex and a vinylidene chloride latex, and a gelatin layer may be provided thereon.

There may be provided a subbing layer comprising a polyethylene swelling agent and gelatin by applying a solution dissolving them. These subbing layers can be combined with a surface treatment to improve further their adhesiveness to a hydrophilic colloid layer.

In the silver halide photographic material of the present invention, the photographic emulsion layers and other layers may be colored with dyes to provide a filter layer for the purpose of absorbing light of a specific wavelength range, i.e., for preventing of halation and irradiation and for controlling the spectral composition of a light incident to the photographic emulsion layers. In both sides-coated film such as an X-ray film for a medial use, a crossover-cutting layer may be provided under the emulsion layer. The dyes used for the above purposes are oxonol dyes and cyanine dyes having a pyrazolone nucleus and a barbituric acid nucleus.

Typical examples of the dyes are shown below but not limited thereto:

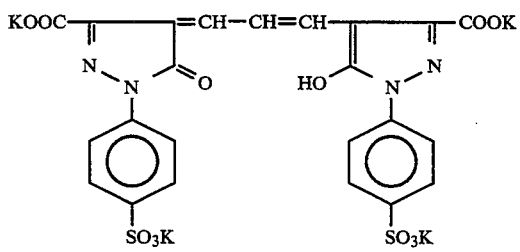

(a)

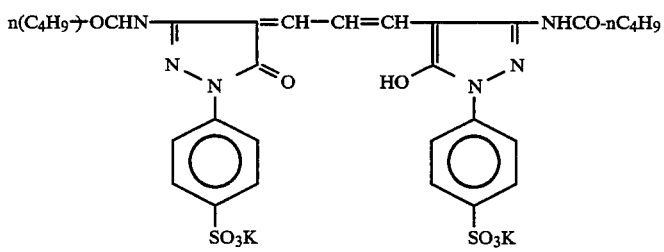

(b)

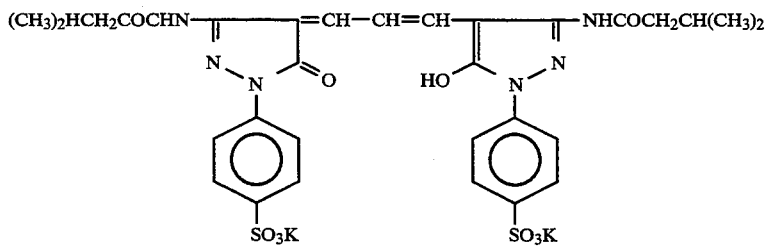

(c)

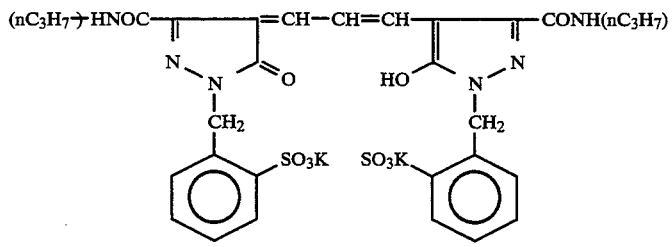

(d)

-continued

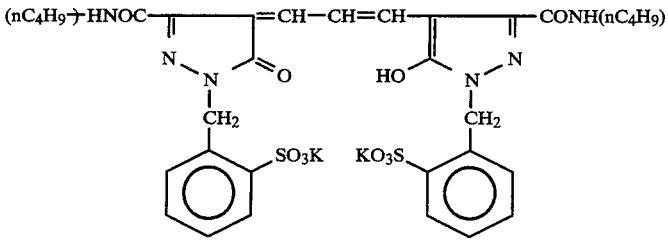

(e)

When using these dyes it is an effective technique to mordant an anionic dye to the specific layer in the light-sensitive material with a polymer having a cationic site. It is preferable to use the dyes which can be irreversibly decolored during the steps of developing, fixing and washing. The layer to which the dyes are mordanted with a polymer having a cationic site may be the emulsion layers, the surface protective layer or the layer opposite to the emulsion layers via a support. It is preferably the layer between the emulsion layers and the support. For the purpose of cutting a crossover in both sides-coated X ray film for medical use, the dyes are mordanted preferably to a subbing layer.

The solid body dispersion method described in JP-A-55-155350 and International Publication WO88/04794 are also effective as a fixing method of dyes.

A polyethylene oxide type nonionic surfactant is used preferably as a coating acid for the subbing layer in combination with a polymer having a cationic site. The polymer having a cationic site is preferably an anion-modified polymer.

There can be used as the anion-modified polymer the various known quaternary ammonium or phosphonium salt polymers. The quaternary ammonium or phosphonium salt polymers are described as mordant polymers and antistatic polymers in the following publications: latexes dispersed in water, described in JP-A-59-166940, JP-A-55-142339, JP-A-54-126027, JP-A-54-155835, JP-A-53-30328, and JP-A-54-92274 and U.S. Pat. No. 3,958,995; polyvinyl pyridinium salts described in U.S. Pat. No. 2,548,564, 3,148,061 and 3,756,814; water-soluble quaternary ammonium salt polymers described in U.S. Pat. No. 3,709,690; and water-soluble quaternary ammonium salt polymers described in U.S. Pat. No. 3,898,088.

It is particularly preferable that the anion-modified polymers are used in the form of aqueous polymer latexes which are cross-linked by copolymerization with a monomer having at least 2, preferably 2 to 4, ethylenically unsaturated groups.

Examples thereof are shown below:

(A)

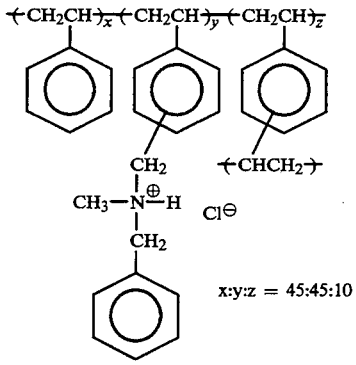

x:y:z = 45:45:10

-continued (B)

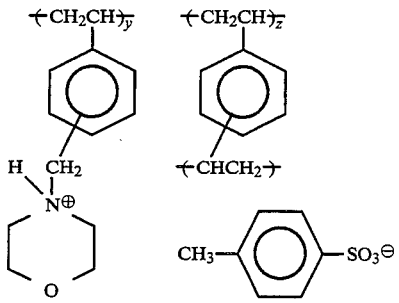

y:z = 95:5

(C)

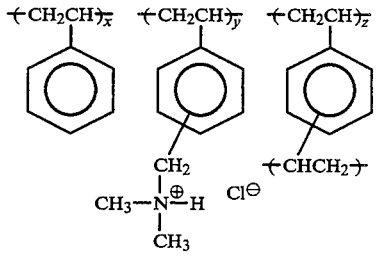

x:y:z = 45:45:10

(d)

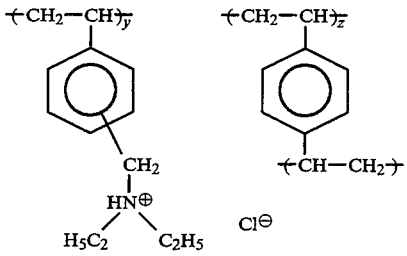

y:z = 80:20

In the present invention, the methods for coating the emulsion layers and surface protective layer on the support are not specifically limited. For example, there can be preferably used the multilayer simultaneous coating method described in U.S. Pat. Nos. 2,761,418, 3,508,947 and 2,761,791.

The developing solutions used in the present invention can contain conventional developing agents. Examples thereof include dihydroxybenzenes (e.g., hydroquinone), 3-pyrazolidones (e.g., 1-phenyl-3-pyrazolidone), and aminophenols (e.g., N-methyl-p-amino-phenol). They can be used singly or in combination. In addition thereto, the developing solutions usually contain the known preservatives, alkali agents, pH buffer agents and antifoggants and if necessary, may further contain a dissolution aid, a color toning agent, a development accelerator (e.g., a quaternary salt, hydrazine and benzyl alcohol), a surfactant, a defoaming agent, a hard water softener, a hardener (glutaric aldehyde), and a tackifier.

The fixing solutions having conventional compositions can be used. There can be used as a fixing agent the organic sulfur compounds having the known effect as the fixing agent as well as thiosulfates and thiocyanates. The fixing agents may contain a water-soluble aluminum salt as the hardener.

In the present invention, a development processing with an automatic processor is carried out preferably with the roller-transporting type automatic processor described in U.S. Pat. Nos. 3,025,779, 3,515,556, 3,573,914, and 3,647,459, and British Patent 1,269,268.

The developing temperature is preferably 18° to 50° C., particularly 30° to 40° C. The developing time is preferably 8 to 40 seconds, particularly 8 to 25 seconds.

The total processing time in all the processing steps of developing, fixing, washing and drying is preferably 30 to 200 seconds, particularly 30 to 100 seconds.

Various additives, the developing method and the exposing method-in the photographic material of the present invention are not specifically limited and one can refer to *Research Disclosure,* Vol. 176, Item 17643 (December 1978) and Vol. 184, Item 18431 (August 1979), for example.

EXAMPLES

The present invention is explained in more detail below with reference to the examples.

EXAMPLE 1

Preparation of Emulsion A

There were added to 1 liter of water, 4.5 g of potassium bromide, 20.6 g of gelatin, and 2.5 ml of a 5% aqueous solution of thioether $HO(CH_2)_2S(CH_2)_2S(CH_2)_2OH$. And a solution containing 3.43 g of silver nitrate and a solution containing 2.97 g of potassium bromide and 0.363 g of potassium iodide were added to the above solution which was kept at 65° C. by a double-jet method for 37 seconds while stirring, followed by adding 0.9 g of potassium bromide and then a solution containing 4.92 g of silver nitrate over a period of 13 minutes. Thereafter, the solution was heated to 70° C. and 18 ml of a 25% ammonia solution were added, followed by adding 17 ml of 100% acetic acid for neutralization. Subsequently, an aqueous solution containing 133.49 g of silver nitrate and an aqueous solution of potassium bromide were added by a controlled double jet method over a period of 35 minutes while maintaining a potential at pAg 8.2. The flowing amount was accelerated so that the flowing amount at the completion of the addition became 2.6 times as much as that at the initiation thereof. After the completion of their addition, 15 ml of a 2N solution of potassium thiocyanate were added and further, 38.5 ml of a 1% aqueous solution of potassium iodide was added for 30 seconds. Then, the temperature of the solution was lowered to 35° C. and the water-soluble salts were removed by a precipitation method. Thereafter, the solution was heated to 40° C. and 68 g of gelatin, 2.35 g of phenoxyethanol were added, followed by adjusting pH and pAg to 6.50 and 8.20, respectively, with caustic soda and potassium bromide.

After raising the temperature to 56° C., 154 mg of 4-hydroxy-6-methyl-1,3,3*a*,7-tetraazaindene were minutes later, 500 mg of the sensitizing dye I-2 were added. An additional 10 minutes later, 3.3 mg of sodium thiosulfate pentahydride, 118 mg of potassium thiocyanate and 2 mg of chlorauric acid were added to the emulsion, followed by rapidly cooling resulting in solidification 70 minutes later, whereby Emulsion A was prepared.

In the obtained emulsion, the grains corresponding to 99.5% of the projected area of the whole grains had aspect ratios of 3 or more and the whole grains having the aspect ratio of 3 or more had an average projected area-corresponding circle diameter of 1.35 μm, a standard deviation of 22.3%, an average thickness of 0.200 μm and an aspect ratio of 6.8.

Preparation of Emulsion B

There were added to 1 liter of water, 4.5 g of potassium bromide, 20.6 g of gelatin, and 2.5 ml of a 5% aqueous solution of thioether $HO(CH_2)_2S(CH_2)_2S(CH_2)_2OH$. And a solution containing 3.43 g of silver nitrate and a solution containing 2.97 g of potassiumbromide and 0.363 g of potassium iodide were added to the above solution which was kept at 65° C. by a double-jet method for 37 seconds while stirring, followed by adding 0.9 g of potassium bromide and then a solution containing 4.92 g of silver nitrate over a period of 13 minutes. Subsequently, 0.1 mg of thiourea dioxide having the following chemical structure was added:

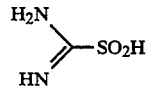

Thereafter, the solution was heated to 70° C. and 18 ml of a 25% ammonia solution were added, followed by adding 17 ml of 100% acetic acid for neutralization. Subsequently, an aqueous solution containing 133.49 g of silver nitrate was added by a controlled double jet method over a period of 35 minutes while maintaining a potential at pAg 8.2. The flowing amount was accelerated so that the flowing amount at the completion of the addition became 2.6 times as much as that at the initiation thereof. After the completion of their addition, 15 ml of a 2N solution of potassium thiocyanate were added and further, 38.5 ml of a 1% aqueous solution of potassium iodide was added for 30 seconds. Then, the temperature of the solution was lowered to 35° C. and the water-soluble salts were removed by a precipitation method. Thereafter, the solution was heated to 40° C. and 68 g of gelatin, 2.35 g of phenoxyethanol were added, followed by adjusting pH and pAg to 6.50 and 8.20, respectively, with caustic soda and potassium bromide.

After raising the temperature to 56° C., 0.05 mg of thiourea dioxide was added. After stirring for 20 minutes, 154 mg of 4-hydroxy-6-methyl-1,3,3*a*,7-tetraazaindene was added and 10 minutes later, 500 mg of the sensitizing dye I-2 was added. Further 10 minutes later, 3.3 mg of sodium thiosulfate pentahydride, 118 mg of potassium thiocyanate and 2 mg of chlorauric acid were added to the emulsion, followed by rapidly cooling for solidification 70 minutes later, whereby Emulsion B was prepared.

Emulsion B was no different in grain size and aspect ratio from Emulsion A in terms of within the measuring errors. The adsorbed amounts of the sensitizing dye in Emulsions A and B which were measured by absorbance measurement of supernatant liquid according to centrifungal separation method were found to be approximately the saturated (100%) adsorption amounts.

Preparation of an Emulsion Coating Solution

The following compounds were added to Emulsions A and B, per mol of silver halide, to thereby prepare coating solution:

| | |
|---|---|
| Polymer latex, copolymer of ethyl acrylate and methacrylic acid (97:3) | 20.0 g |
| Hardener, 1,2-bis(vinylsulfonylacetoamide) ethane | 2.4 g |
| 2,6-Bis(hydroxyamino)-4-diethylamino-1,3,3a,5-triazine | 76 mg |
| Polysodium acrylate (an average molecular weigtht: 41,000) | 2.1 g |
| Poly-sodium styrenesulfonate (an average molecular weight: 600,000) | 1.0 g |
| Dextran (a molecular weight: 39,000) | 23.6 g |
| Trimethylol propane | 9.8 g |
| Potassium hydroquinone monosulfonate | 9.7 g |
| 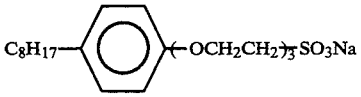 | 0.6 g |
| 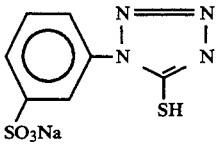 | 32 mg |

A dye of Formula (II) in the amount shown in Table 1.

Preparation of a Support

A subbing layer having a coated amount of 84 mg/m$^2$ of gelatin was provided on both sides of a blue-colored polyethylene terephthalate of 175 μm thickness to prepare the support.

Preparation of the Photographic Material Samples

The above coating solution and surface protective layer coating solution were coated on the above support. Both sides of the support were coated in the silver coated amount of 1.95 g/m$^2$ per one side.

The surface protective layer coating solution was prepared and coated so that the respective components were in the following coated amounts, whereby the photographic material Samples No. 1 to 14 were prepared:

| Components of the surface protective layer | Coated amount |
|---|---|
| Gelatin | 1.138 g/m$^2$ |
| Dextran (an average molecular weight: 39,000) | 0.228 g/m$^2$ |
| 4-Hydroxy-6-methyl-1,3,3a,7-tetraazaindene | 0.0155 g/m$^2$ |
| Poly-sodium acrylate (an average molecular weight: 41,000) | 0.023 g/m$^2$ |
| 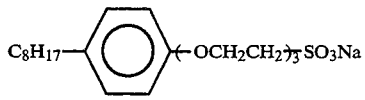 | 0.0225 g/m$^2$ |
| $C_{16}H_{33}O(CH_2CH_2O)_{10}H$ | 0.025 g/m$^2$ |
| $C_8F_{17}SO_2N(C_3H_7)(CH_2CH_2O)_4(CH_2)_4SO_3Na$ | 0.0005 g/m$^2$ |
| $C_8F_{17}SO_3K$ | 0.0053 g/m$^2$ |
| Polymethyl methacrylate (an average grain size: 3.7 μm) | 0.088 g/m$^2$ |
| Proxel | 0.0006 g/m$^2$ |

Both sides of the photographic material Sample Nos. 1 to 14 were exposed to green light having a peak at 550 nm for 1/10 second and then subjected to processing at 35° C. for 90 seconds with automatic processors FPM 4000 manufactured by Fuji Photo Film Co., Ltd., using the following two kinds of the developing solutions and the fixing solution Fuji F made by Fuji Photo Film Co., Ltd.:

(1) Developing solution-1 RD-3*+KBr 3 g/l (2) Developing solution-2 RD-3*+KBr 3 g/l+KI 10 mg/l

*: trade name, manufactured by Fuji Photo Film Co., Ltd.

Evaluation of Sensitivity

Sensitivity was defined by the reciprocal necessary to give the density of fog +1.0 and was expressed by the value relative to that of Sample No. 1 processed by Developing solution-1, which was set at 100. Fog was expressed by the value obtained by deducting the density of the support from the background density.

The results are shown in Table 1.

It is apparent form the results in Table 1 that the samples of the present invention have an improved balance between sensitivity and fog. Particularly, the effect of the present invention is notable with developing solution-2 which is likely to cause the fog.

TABLE 1

| | | Dye of Formula (II) | | Developing Solution 1 | | Developing Solution 2 | |
|---|---|---|---|---|---|---|---|
| Sample No. | Emulsion | Dye No. | Added Amount (mol/mol Ag) | Sensitivity | Fog | Sensitivity | Fog |
| 1 (Comp.) | A | — | — | 100 | 0.020 | 126 | 0.070 |
| 2 (Comp.) | B | — | — | 126 | 0.025 | 159 | 0.072 |
| 3 (Inv.) | B | II-13 | $4.4 \times 10^{-5}$ | 123 | 0.020 | 159 | 0.054 |
| 4 (Inv.) | B | II-30 | $2.4 \times 10^{-5}$ | 126 | 0.022 | 159 | 0.060 |
| 5 (Inv.) | B | II-30 | $4.4 \times 10^{-5}$ | 123 | 0.020 | 159 | 0.050 |
| 6 (Inv.) | B | II-30 | $2.3 \times 10^{-4}$ | 120 | 0.016 | 159 | 0.044 |
| 7 (Inv.) | B | II-32 | $4.4 \times 10^{-5}$ | 123 | 0.020 | 155 | 0.058 |
| 8 (Inv.) | B | II-32 | $1.1 \times 10^{-4}$ | 120 | 0.018 | 152 | 0.048 |
| 9 (Inv.) | B | II-29 | $4.4 \times 10^{-5}$ | 123 | 0.020 | 159 | 0.058 |
| 10 (Inv.) | B | II-29 | $1.1 \times 10^{-4}$ | 123 | 0.018 | 155 | 0.052 |
| 11 (Inv.) | B | II-28 | $4.4 \times 10^{-5}$ | 123 | 0.020 | 155 | 0.058 |
| 12 (Inv.) | B | II-28 | $1.1 \times 10^{-4}$ | 120 | 0.016 | 152 | 0.048 |
| 13 (Inv.) | B | II-17 | $4.4 \times 10^{-5}$ | 123 | 0.018 | 155 | 0.052 |

TABLE 1-continued

| Sample No. | Emulsion | Dye of Formula (II) Dye No. | Dye of Formula (II) Added Amount (mol/mol Ag) | Developing Solution 1 Sensitivity | Developing Solution 1 Fog | Developing Solution 2 Sensitivity | Developing Solution 2 Fog |
|---|---|---|---|---|---|---|---|
| 14 (Inv.) | B | II-17 | $1.1 \times 10^{-4}$ | 120 | 0.018 | 152 | 0.038 |

EXAMPLE 2

The photographic material Sample Nos. 1 to 14 were subjected to the following processing and their photographic properties were evaluated.

The results were essentially the same as in Example 1 and it has been shown that the effect of the present invention remains unchanged even if the processing method is different.

Development Processing

Preparation of a condensed solution

| | |
|---|---|
| Developing solution | |
| Solution A | |
| Potassium hydroxide | 330 g |
| Potassium sulfite | 630 g |
| Sodium sulfite | 240 g |
| Potassium carbonate | 90 g |
| Boric acid | 45 g |
| Diethylene glycol | 180 g |
| Diethylenetriamine pentacetic acid | 30 g |
| 3,3'-Dithiobishydro cinnamic acid | 3 g |
| 5-Methylbenzotriazole | 0.025 g |
| Hydroquinone | 450 g |
| Potassium bromide | 15 g |
| Water was added to make the total quantity | 4,125 ml |
| Solution B | |
| Trithylene glycol | 525 g |
| Glacial acetic acid | 102.6 g |
| 5-Nitoindazole | 3.75 g |
| 1-Phenyl-3-pyrazolidone | 34.5 g |
| Water was added to make the total quantity | 750 ml |
| Solution C | |
| Glutaric aldehyde (50 wt/wt %) | 150 g |
| Potassium metabisulfite | 150 g |
| Water was added to make the total quantity | 750 ml |
| Fixing solution (Mono-solution composition) | |
| Ammonium thiosulfate (70 wt/vol %) | 200 ml |
| Disodium ethylenediamine tetracetate dihydride | 0.003 g |
| Sodium thiosulfate pentahydride | 10 g |
| Sodium sulfite | 15 g |
| Boric acid | 4 g |
| 1-(N,N-dimethylamino) ethyl-5-mercaptotetrazole | 1 g |
| Tartaric acid | 3.2 g |
| Glacial acetic acid | 31.5 g |
| Sodium hydroxide | 11 g |
| Sulfuric acid (36N) | 3.9 g |
| Aluminum sulfate | 10 g |
| Water was added to make the total quantity | 400 ml |
| pH | 4.65 |

Preparation of the Processing Solutions

The above condensed developing solutions were added to a polyethylene vessel as a solution. This vessel consisted of Solutions A, B and C, in which the respective bottles were linked to each other.

The above condensed fixing solution was also added to a polyethylene vessel.

These developing and fixing solutions were added to the developer and fixer tanks of an automatic processor, respectively, with a measuring pump equipped in the processor in the following proportions:

| | |
|---|---|
| Developing solution | |
| Solution A | 55 ml |
| Solution B | 10 ml |
| Solution C | 10 ml |
| Water | 125 ml |
| pH | 10.50 |
| Fixing solution | |
| Condensed solution | 80 ml |
| Water | 120 ml |
| pH | 4.65 |

A washing-water tank was filled with tap water and at the bottom thereof were placed four bags of unwoven cloths in which there was wrapped a silver slow-releasing agent (the brand Biosure SG manufactured by Kinki Pipe Giken Co., Ltd.) containing 0.5 wt % of $Ag_2O$ in a soluble glass comprising $Na_2O$, $B_2O_5$ and $SiO_2$.

Constitution of the Automatic Processor

An automatic processor of the following specifications was used:

| | Solution amount in tank (l) | Processing temperature (°C.) | Processing path length (mm) | Processing time (sec) |
|---|---|---|---|---|
| Developing | 15 | 35 | 613 | 13.3 |
| Fixing | 15 | 32 | 541 | 11.7 |
| Washing | 13 | 17 | 305 | 5.7 |
| Squeeze | — | — | — | 6.6 |
| Drying | — | 58 | 368 | 8.0 |
| Total | — | — | 1,827 | 45.3 |

Ratio of solution surface area and tank volume in the developing tank: 35 $cm^2/l$

Processing

The above photographic material samples were exposed to an X-ray and subjected to processing by the above automatic processor using the processing solutions prepared in the above proportions while replenishing each with 25 ml per sheet (10×12 inch) of the developing solution and fixing solution.

Washing water was supplied in a flowing amount of 10 liter per minute (about 1 l/sheet of 10×12 inch) with a magnetic valve which opened in synchronized time to when the photographic materials were processed. When daily operations were finished, the magnetic valve was automatically opened to drain all water in the tank.

Thus, the automatic processor was sufficiently operated for running processing until the developing solution as well as the fixing solution reached the running balanced compositions. Thereafter, the photographic material samples were subjected to the processing and then to the evaluation of their photographic properties.

EXAMPLE 3

Preparation of a Support

A biaxially stretched blue-colored polyethylene terephthalate film having 175 μm in thickness was subjected to a corona discharge and the first subbing layer having the following composition was coated thereon with a wire bar coater so that the coated amount was 5.1 ml/m$^2$, followed by drying at 175° C. for one minute. Next, the first subbing layer was provided in the same manner on the opposite side of the support.

| Composition of the first subbing layer | |
|---|---|
| Butadiene-styrene copolymer latex (solid content: 40%, weight ratio of butadiene/styrene: 31/69) | 79 ml |
| Sodium 2,4-dichloro-6-hydroxy-s-triazine (4% aqueous solution) | 20.5 ml |
| Distilled water | 900.5 ml |

In the above composition, the following compound was added to the latex solution as a emulsion-dispersant in a proportion of 0.4 wt % based on the solid content contained in the latex:

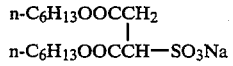

The following Solutions (a) and (b) were prepared and mixed together after their respective solutions became uniform, whereby a second subbing layer coating solution was prepared.

| Composition of Solution (a) | |
|---|---|
| Gelatin | 8 g |
| polymer latex (solid content: 15%) | 31 ml |
| 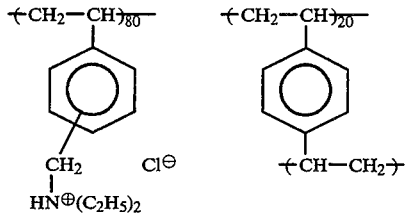 | |
| Dye (3%) solution | 63 ml |
| 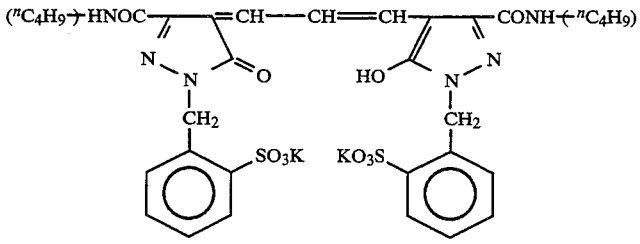 | |
| 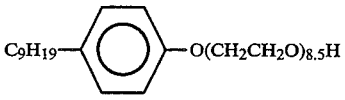 | |
| (1% solution) | 20 ml |
| Methyl cellulose (Metolose SM15 manufactured by Shinetsu Chemical Co.) | 0.2 g |
| Water | 567 ml |
| **Composition of the solution (b)** | |
| Gelatin | 2 g |
| Matting agent (polymethyl methacrylate, an average particle size: 2.5 μm) | 0.3 g |
| 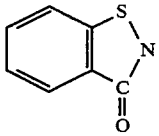 | |
| (3.5% solution) | 1 ml |
| Water | 308 ml |

The mixture of the Solutions (a) and (b) was coated on both sides of the above first subbing layer so that the coated amount per one side was 8.5 ml/m$^2$, followed by drying, whereby the subbed film was prepared.

Preparation of Emulsion C

There were added to 1 liter of water, 5 g of potassium bromide, 0.05 g of potassium iodide, 26 g of gelatin, and 2.5 ml of a 5% aqueous solution of thioether $HO(CH_2)_2S(CH_2)_2S(CH_2)_2OH$. And a solution containing 6.48 g of silver nitrate and a solution containing 5.72 g of potassium bromide and 0.70 g of potassium iodide were added to the above solution kept at 73° C. by a double-jet method for 37 seconds while stirring, followed by adding 2.9 g of potassium bromide and then a solution containing 10.2 g of silver nitrate over a period of 13 minutes. Subsequently, an aqueous solution containing 166.9 g of silver nitrate and an aqueous solution containing 183.9 g of potassiumbromide and 1.02 g of potassium iodide were added by the controlled double jet method over a period of 30 minutes while maintaining the potential at PAg 8.1. The flowing amount was accelerated so that the flowing amount at the completion of the addition became 7 times as much as that at the initiation thereof. After the completion of the addition, 15 ml of a 2N solution of potassium thiocyanate was added and further, 60 ml of a 1% aqueous solution of potassium iodide was added for 30 seconds. Then, the temperature of the solution was lowered to 35° C. and the water-soluble salts were removed by a precipitation method. Thereafter, the solution was heated to 40° C. and 65 g of gelatin, 2 g of phenol and 7.5 g of trimethylolpropane were added, followed by adjusting pH and pAg to 6.40 and 8.35, respectively, with caustic soda and potassium bromide.

After raising the temperature to 56° C., 0.06 mg of thiourea dioxide was added and stirred for 20 minutes. Then, 200 mg of 4-hydroxy-6-methyl-1,3,3*a*,7-tetraazaindene was added and 10 minutes later, 670 mg of the sensitizing dye I-2 was added. An additional 10 minutes later, 5.3 mg of sodium thiosulfate pentahydride, 163 mg of potassium thiocyanate and 5.0 mg of chlorauric acid were added to the emulsion, followed by rapid cooling for solidification 60 minutes later, whereby Emulsion C was prepared.

In the obtained emulsion, the grains corresponding to 95% of the projected area of the whole grains had an aspect ratio of 3 or more and the whole grains having an aspect ratio of 2 or more had an average projected area-corresponding circle diameter of 1.04 μm, a standing deviation of 21.5%, an average thickness of 0.165 μm and an aspect ratio of 6.2.

Preparation of Emulsion D

The procedure for the preparation of Emulsion C was repeated to prepare Emulsion D, except that thiourea dioxide was not added before the chemical ripening. The physical properties of the obtained emulsion such as a grain size and an aspect ratio were not different from those of Emulsion C in terms of within the measuring errors.

Preparation of Emulsion E

There were added to 1 liter of water, 4.5 g of aqueous solution of thioether $HO(CH_2)_2S(CH_2)_2S(CH_2)_2OH$. A potassium bromide, 20.6 g of gelatin and 2.5 ml of a 5% solution containing 3.43 g of silver nitrate and a solution containing 2.97 g of potassium bromide and 0,363 g of potassium iodide were added to the above solution kept at 65° C. by a double-jet method for 37 seconds while stirring, followed by adding 0.9 g of potassium bromide and then a solution containing 4.92 g of silver nitrate over a-period of 13 minutes. Subsequently, 0.1 mg of thiourea dioxide having the following chemical structure was added:

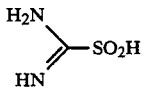

Thereafter, the solution was heated to 70° C. and 18 ml of a 25% ammonia solution were added, followed by adding 17 ml of 100% acetic acid for neutralization. Subsequently, an aqueous solution containing 149.8 g of silver nitrate was added by a controlled double jet method over a period of 42 minutes while maintaining the potential at pAg 8.2. The flowing amount was accelerated so that the flowing amount at the completion of the addition became 3.5 times as much as that at the initiation thereof. After the completion of the addition, 15 ml of a 2N solution of potassium thiocyanate was added and further, 38.5 ml of a 1% aqueous solution of potassium iodide was added for 30 seconds. Then, the temperature of the solution was lowered to 35° C. and the water-soluble salts were removed by a precipitation method. Thereafter, the solution was heated to 40° C. and 78 g of gelatin and 2.35 g of phenoxyethanol were added, followed by adjusting the pH and pAg to 5.90 and 8.20, respectively, with caustic soda and potassium bromide.

After raising the temperature to 56° C., 0.05 mg of thiourea dioxide was added. After stirring for 10 minutes, 154 mg of 4-hydroxy-6-methyl-1,3,3*a*,7-tetraazaindene was added and 5 minutes later, 500 mg of Sensitizing Dye I-2 was added. Further 10 minutes later, 3.3 mg of sodium thiosolfate pentahydride, 118 mg of potassium thiocyanate and 2 mg of chlorauric acid were added to the emulsion, followed by rapid cooling for solidification 70 minutes later, whereby Emulsion E was prepared.

In the obtained emulsion, the grains corresponding to 99.5% of the projected area of the whole grains had an aspect ratio of 3 or more and the whole grains having an aspect ratio of 3 or more had an average projected area-corresponding circle diameter of 1.45 μm, a standard deviation of 23.5%, an average thickness of 0.215 μm and an aspect ratio of 6.7.

Preparation of Emulsion F

Emulsion F was prepared in the same manner as Emulsion E, except that the thiourea dioxide added during the formation of the grains and before the chemical ripening was not added. The physical properties of the obtained emulsion such as grain size and aspect ratio were not different from those of Emulsion E within measuring error.

Preparation of the Emulsion Coating Solution

The following compounds were added to Emulsions C and D in amounts shown below per mol of silver halide, to thereby prepare the first layer coating solution:

| | |
|---|---|
| Polymer latex, copolymer of ethyl acrylate and methacrylic acid (97:3) | 20.0 g |
| Hardener, 1,2-bis(vinylsulfonylacetoamide) ethane | 1.8 g |
| 2,6-bis(hydroxyamino)-4-diethylamino-1,3,3a-5-triazine | 76 mg |
| Poly-sodium acrylate (an average molecular weight: 41,000) | 2.1 g |
| Poly-sodium styrenesulfonate (an average molecular weight: 600,000) | 1.0 g |

-continued

| | |
|---|---|
| Dextran (a molecular weight: 39,000) | 23.6 g |
| Trimethylol propane | 9.8 g |
| 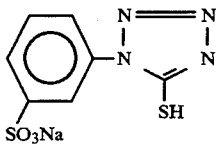 | 32 mg |

The dye of Formula (II) and its amount are shown in Table 2.

Further, the following compounds were added to Emulsions E and F in amounts per mol of silver halide, to thereby prepare the second layer coating solution:

| | |
|---|---|
| Polymer latex, copolymer of ethyl acrylate and methacrylic acid (97:3) | 20.0 g |
| Hardener, 1,2-bis(vinylsulfonyl acetoamide) ethane | 2.2 g |
| 2,6-bis(hydroxyamino)-4-diethylamino-1,3,3a,5-triazine | 76 mg |
| Poly-sodium acrylate (an average molecular weight: 41,000) | 2.1 g |
| Poly-sodium styrenesulfonate (an average molecular weight: 600,000) | 1.0 g |
| Dextran (a molecular weight: 39,000) | 23.6 g |
| Trimethylol propane | 9.8 g |
| 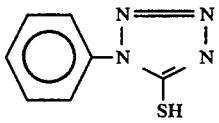 | 45 mg |
| 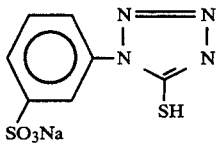 | 32 mg |

The dye of Formula (II) and its amount are shown in Table 2.

Preparation of the Photographic Material Samples

The first layer coating solution, the second layer coating solution and the surface protective layer coating solution were simultaneously coated in this order on the both sides of the above transparent support. The silver coated amount per one side was 1.8 g/m$^2$ (first layer: 1.0 g/m$^2$, second layer: 0.8 g/m$^2$), whereby the photographic material Sample Nos. 15 to 32 were prepared. The coated amounts for each side of the components in the surface protective layer are shown below:

| Components of the protective layer | Coated amount (g/m$^2$) |
|---|---|
| Gelatin | 0.966 |
| Polyacrylamide (an average molecular weight: 45,000) | 0.227 |
| 4-Hydroxy-6-methyl-1,3,3a,7-tetraazaindene | 0.0155 |
| Poly-sodium acrylate (an average molecular weight: 400,000) | 0.023 |
| 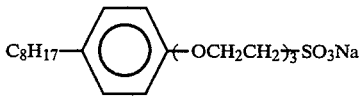 | 0.013 |
| $C_{16}H_{33}O(CH_2CH_2O)_{10}H$ | 0.045 |
| $C_{17}H_{33}CON(C_3H_7)CH_2CH_2SO_3Na$ | 0.0065 |
| $C_8F_{17}SO_2N(C_3H_7)(CH_2CH_2O)_{15}H$ | 0.003 |
| $C_8F_{17}SO_2N(C_3H_7)(CH_2CH_2O)_4(CH_2)_4SO_3Na$ | 0.001 |
| Polymethyl methacrylate (an average grain size: 3.7 μm) | 0.087 |
| Chlorohydroquinone | 0.046 |
| Proxel | 0.0005 |

Both sides of the photographic material Sample Nos. 15 to 32 were exposed to green light having a peak at 550 nm for 10 second and then subjected to processing by automatic processor FPM 9000 manufactured by Fuji Photo Film Co., Ltd., at 35° C. for 45 seconds by using the following two kinds of the developing solutions and the fixing solution Fuji F:

(1) Developing solution-3 RD-7*+KBr 3 g/liter (2) Developing solution-4 RD-7*+KBr 3 g/liter+KI 10 mg/liter

*: trade name, manufactured by Fuji Photo Film Co., Ltd.

Evaluation of a Sensitivity

Sensitivity was defined by the reciprocal necessary to give the density of fog +1.0 and was expressed by the value relative to that of Sample No. 15 processed by using Developing solution-3, which was set at 100. Fog was expressed by the value obtained by deducting the density of the support from the background density.

The results are shown in Table 2.

It is apparent from the results in Table 2 that even in a multilayer structure, the samples of the present invention have improved balance between sensitivity and fog. Particularly, the effect of the present invention is notable in the Developing Solution-4 which is likely to cause the fog.

TABLE 2

| | First Layer | | | Second Layer | | | Developing Solution 1 | | Developing Solution 2 | |
|---|---|---|---|---|---|---|---|---|---|---|
| | | Dye of Formula (II) | | | Dye of Formula (II) | | | | | |
| Sample No. | Em | dye No. | Add. Amnt. *1 | Em | Dye No. | Add. Amnt. *1 | S*2 | Fog | S*2 | Fog |
| 15 (comp.) | D | — | — | F | — | — | 100 | 0.021 | 123 | 0.70 |
| 16 (Comp.) | C | — | — | F | — | — | 110 | 0.023 | 133 | 0.072 |
| 17 (Comp.) | D | — | — | E | — | — | 122 | 0.026 | 142 | 0.075 |
| 18 (comp.) | C | — | — | E | — | — | 132 | 0.028 | 156 | 0.080 |
| 19 (Comp.) | D | II-30 | $2.5 \times 10^{-4}$ | E | — | — | 120 | 0.022 | 139 | 0.072 |
| 20 (Inv.) | C | II-30 | $2.5 \times 10^{-4}$ | E | — | — | 131 | 0.022 | 155 | 0.054 |
| 21 (Inv.) | D | — | — | E | II-30 | $2.5 \times 10^{-4}$ | 120 | 0.021 | 138 | 0.051 |
| 22 (Inv.) | C | — | — | E | II-30 | $2.5 \times 10^{-4}$ | 130 | 0.020 | 153 | 0.050 |

TABLE 2-continued

| Sample No. | First Layer Em | First Layer Dye of Formula (II) dye No. | First Layer Dye of Formula (II) Add. Amnt. *1 | Second Layer Em | Second Layer Dye of Formula (II) Dye No. | Second Layer Dye of Formula (II) Add. Amnt. *1 | Developing Solution 1 S*2 | Developing Solution 1 Fog | Developing Solution 2 S*2 | Developing Solution 2 Fog |
|---|---|---|---|---|---|---|---|---|---|---|
| 23 (Inv.) | D | II-30 | $2.5 \times 10^{-4}$ | E | II-30 | $2.5 \times 10^{-4}$ | 119 | 0.017 | 138 | 0.038 |
| 24 (Inv.) | C | II-30 | $2.5 \times 10^{-4}$ | E | II-30 | $2.5 \times 10^{-4}$ | 130 | 0.016 | 154 | 0.036 |
| 25 (Inv.) | C | II-30 | $2.5 \times 10^{-4}$ | E | II-3 | $2.5 \times 10^{-4}$ | 128 | 0.017 | 150 | 0.036 |
| 26 (Inv.) | C | II-30 | $2.5 \times 10^{-4}$ | E | II-13 | $2.5 \times 10^{-4}$ | 130 | 0.017 | 154 | 0.038 |
| 27 (Inv.) | C | II-30 | $2.5 \times 10^{-4}$ | E | II-19 | $2.5 \times 10^{-4}$ | 127 | 0.016 | 152 | 0.037 |
| 28 (Inv.) | C | II-30 | $2.5 \times 10^{-4}$ | E | II-24 | $2.5 \times 10^{-4}$ | 129 | 0.016 | 153 | 0.037 |
| 29 (Inv.) | C | II-30 | $2.5 \times 10^{-4}$ | E | II-32 | $2.5 \times 10^{-4}$ | 131 | 0.018 | 154 | 0.038 |
| 30 (Inv.) | C | II-3 | $2.5 \times 10^{-4}$ | E | II-30 | $2.5 \times 10^{-4}$ | 130 | 0.017 | 152 | 0.038 |
| 31 (Inv.) | C | II-24 | $2.5 \times 10^{-4}$ | E | II-30 | $2.5 \times 10^{-4}$ | 127 | 0.017 | 150 | 0.036 |

*1: Added amount (mol/mol of Ag),
*2: Sensitivity

While the invention has been described-in detail and with reference to specific embodiments thereof, it will be apparent to one skilled in the art that various changes and modifications can be made therein without departing from the spirit and scope thereof.

What is claimed is:

1. A silver halide photographic material comprising a support and at least one light-sensitive silver halide emulsion layer coated on at least one side of the support; wherein, the silver halide grains contained in the silver halide emulsion layer have been subjected to reduction-sensitization, the silver halide emulsion contains at least one spectral sensitizer represented by the following Formula (I), and further at least one of the dyes represented by the following Formula (II) is added to the silver halide emulsion after chemical sensitization or reduction sensitization, but before coating:

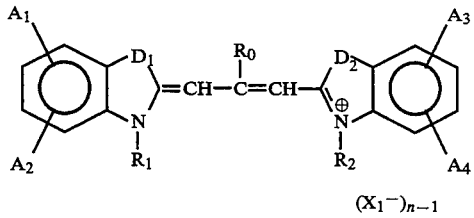

(I)

wherein $A_1$, $A_2$, $A_3$ and $A_4$ each represents a hydrogen atom, a lower alkyl group, an alkoxy group, a halogen atom, a hydroxyl group, an aryl group, a carboxyl group, an alkoxycarbonyl group, a cyano group, a trifluoromethyl group, an amino group, an acylamide group, an acyl group, an acyloxyl group, an alkoxycarbonylamino group, and a carboalkoxy group, wherein $A_1$ and $A_2$, and $A_3$ and $A_4$ may combine with each other to form a naphthoxazole nucleus; $R_0$ represents a hydrogen atom, a lower alkyl group, or an aryl group; $D_1$ and $D_2$ each represents an oxygen atom or a sulfur atom; $R_1$ and $R_2$ each represents an alkyl group, provided that at least one of $R_1$ and $R_2$ is an alkyl group having a sulfo radical; $X_1$ represents an anion; and n is 1 or 2, provided that n is 1 when the dye forms an inner salt;

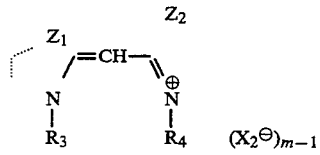

(II)

wherein $Z_1$ and $Z_2$ each represents the group of non-metallic atoms necessary to complete a thiazole nucleus, a thiazoline nucleus, an oxazole nucleus, a selenazole nucleus, a 3,3 -dialkylindolenine nucleus, an imidazole nucleus, or a pyridine nucleus; $R_3$ and $R_4$ each represents an alkyl group; $X_2$ represents an anion; and m is 1 or 2, provided that m is 1 when the dye forms an inner salt; and wherein the addition amount of the dye of Formula (I) is $5\times10^{-4}$ to $3\times10^{-3}$ tool per tool of silver halide and the addition amount of the dye of Formula (II) is $1\times10^{-5}$ to $1\times10^{-3}$ mol per mol of silver halide, provided that the addition amount of the dye of Formula (I) is more than that of the dye of Formula (II).

2. The silver halide photographic material as in claim 1, wherein the addition amount of the dye of Formula (I) is $6\times10^{-4}$ to $1.2\times10^{-3}$ mol per mol of silver halide and the addition amount of the dye of Formula (II) is $2\times10^{-5}$ to $5\times10^{-4}$ mol per mol of silver halide, provided that the addition amount of the dye of Formula (I) is more than that of the dye of Formula (II).

3. The silver halide photographic material as in claim 1, wherein the dye of Formula (II) is added to the silver halide emulsion at the time immediately before coating.

4. The silver halide photographic material as in claim 1, wherein the silver halide grains comprise tabular silver halide grains having an aspect ratio corresponding to at least 50% of the whole projected area of 3 or more.

5. The silver halide photographic material as in claim 1, wherein the silver halide grains are monodispersed hexagonal tabular grains.

6. The silver halide photographic material as in claim 1, wherein the aspect ratio of all grains having a thickness of 0.3 μm or less is 3 or more.

7. The silver halide photographic material as in claim 1, wherein the silver halide grains have been subjected to halogen conversion.

8. The silver halide photographic material as in claim 7, wherein the halogen conversion of the silver halide grains occurred in the presence of a silver halide solvent.

9. The silver halide photographic-material as in claim 8, wherein the silver halide solvent is a thioether compound, thiocyanate, ammonia or a 4-substituted thiourea.

* * * * *